US005193752A

United States Patent [19]

Yukimi

[11] Patent Number: 5,193,752

[45] Date of Patent: Mar. 16, 1993

[54] METHOD OF MAKING CONCRETE SAND

[75] Inventor: Oogawara Yukimi, Yazu, Japan

[73] Assignee: Nakaya Jitsugyo Co., Ltd., Tottori, Japan

[21] Appl. No.: 813,826

[22] Filed: Dec. 27, 1991

[51] Int. Cl.[5] ..... B02C 17/02

[52] U.S. Cl. ..... 241/21; 241/29; 241/DIG. 10

[58] Field of Search ..... 241/21, 62, DIG. 10, 241/29

[56] References Cited

U.S. PATENT DOCUMENTS

| | | | |
|---|---|---|---|
| 3,712,549 | 1/1973 | Cleemann | 241/19 |
| 3,862,719 | 1/1975 | Muller | 241/74 |
| 4,013,233 | 3/1977 | Nylund | 241/80 |
| 4,995,561 | 2/1991 | Yukimi | 241/62 |

FOREIGN PATENT DOCUMENTS

| | | | |
|---|---|---|---|
| 0384004 | 8/1990 | European Pat. Off. | 241/79.3 |
| 1487981 | 6/1989 | U.S.S.R. | 241/21 |
| 1503878 | 8/1989 | U.S.S.R. | 241/79.3 |

*Primary Examiner*—Mark Rosenbaum
*Assistant Examiner*—John M. Husar
*Attorney, Agent, or Firm*—Kanesaka & Takeuchi

[57] ABSTRACT

A method of making concrete sand includes grinding a mixture of medium stones 3, material sand 4, and water 5 in the inner milling chamber 2 of a first rotating cylindrical drum 1. The medium stones 3 are maintained to a height equal to ¼ to ⅓ the inner diameter of the first cylindrical drum 1. The number of rotation of the first cylindrical drum 1 is decreased as the inner diameter of the same increases. The supply of the water 5 is controlled in precise or approximate proportion to the feeding of the material sand 4. The medium stones 3 are prepared by a novel manner from rubble stones 24 using a second cylindrical drum 11.

6 Claims, 7 Drawing Sheets

METHOD OF MAKING CONCRETE SAND

TECHNICAL FIELD

The present invention relates to a method of making concrete sand in which a mixture of medium stones, material sand, and water is agitated in a rotating cylindrical drum to produce fine grains of concrete sand.

BACKGROUND OF THE INVENTION

A rod mill is a well-known apparatus for making concrete sand, which has a plurality of metal rods rotatably mounted in the milling chamber of a cylindrical drum. In action, as the cylindrical drum rotates, the metal rods crush down material sand to grains of sand by application of impact force. The hardness of the metal rods is far greater than that of the material sand and the impact force applied by the metal rods becomes high. The the metal rods crush the sand with little grinding effect and have no abrasive action which gradually grind down the surface of each material sand grain. Hence, the resultant grain sand produced with such a rod mill is low in quality for use as a finely sized aggregate material for making concrete. On the other hand, natural river sand, mountain sand, sea sand, and land sand are more preferable for use as aggregate sand. Among them, the river sand which is very rigid and almost spherical in the grain shape, exhibits the most desirable quality. It was found through experiment that the percentage of round shaped grains of common water rinsed river sand (calculated through dividing the mass of a unit volume by an absolute dryness specific weight) conforming to JIS A5004 was 57% to 59% while the same of crushed sand produced with a known rod mill was about 53%. Also, grains of the crushed sand are not round but angular and flat in the shape and their surface is not smooth and may have cracks. Those disadvantages will affect the properties of liquid concrete including workability and fluidity.

The applicant invented a novel method of making crushed sand (which was filed in the U.S. Patent Office and issued as U.S. Pat. No.4,995,561 and published by the European Patent Office as EP 0384004 A2).

In more detail, the method is illustrated in FIG. 9 in which material sand 4 is continuously fed together with water 5 into an inner milling chamber 2 of a cylindrical drum 1 which is loaded with a pile of medium stones 3. The material sand 4 is milled in of the cylindrical drum 1 rotated by a drive means to provide milled grains of sand 6, which is in turn unloaded from an exit 7 together with used water. Through the milling action together with water and medium stones, material sand will be ground under a condition similar to that in which river sand is produced from rubble stones by the action of nature. More specifically, the material sand is ground such that impurities on its surface are removed, and the shape of each grain becomes round. The resultant sand is as good as natural river sand, having a quality of an aggregate material which is neither angular nor flat but has a smooth surface which has few or no crack.

However, the concrete sand making method invented by the applicant still has a drawback to be overcome.

For grinding the material sand 4 under the optimum conditions, it is essential that the medium stones 3 which act as abrasives to the material sand 4 are round in shape, like pebbles or ballast stones which are rolled to round shapes in river water. To have such naturally existing round stones or river pebbles in bulk requires large amounts of tough, troublesome labor and time. Since natural round pebbles are limited in amount, they are not practical.

Also, the medium stones 3 are worn partially through the milling action to particles of the milled sand 6. If the particles contain unfavorable substances, they will chemically react with alkali components of a cement thus causing expansion and fracture of the resultant concrete solid of the aggregate sand 6. In addition, steel bars when used for reinforcement of concrete will suffer from corrosion.

When the medium stones 3 exhibit an improper absolute dryness specific weight and are low in the roundness, their pressing or grinding force to the material sand 4 remains less than a desired level, and no optimum abrasive action is obtained. Furthermore, the medium stones 3 become low in the rigidity and hardness and readily break up into bits and pieces.

As described above, it is more preferable to use artificially cracked rubbles rather than naturally ground pebbles in view of amounts of labor or time and the limited amount of natural pebbles. The cracked rubbles however are not round but angular and unsuited for carrying out an abrasive action to material sand.

It is not possible to produce fine grains of sand when such artificially cracked rubbles are used directly with no preparatory action of proper rounding. The cracked, angular rubbles must be rounded.

Meanwhile, the medium stones 3 in the inner milling chamber 2 of the cylindrical drum 1 have to stay a certain level, not too much nor too little, in the overall amount for execution of an optimum grinding action to the material sand 4. As being worn off during the grinding action, the medium stones 3 are reduced with time in the size.

Also, the ratio in supply amount between the material sand 4 and the water 5 is an important factor to enhance the quality of the resultant ground sand 6. If the ratio is improper, the fluidity of the material sand 4 during milling will decline thus preventing even mixture of the material sand 4 and the medium stones 3.

If the rotation per unit time of the cylindrical drum 1 is too fast, the medium stones 3 will be lifted upward along the inner wall of the drum 1 thus decreasing the grinding effect. If it is too slow, the movement of the material sand 4 axially of the cylindrical drum 1 will be retarded thus traveling less smoothly towards the exit 7.

SUMMARY OF THE INVENTION

The inventor of the present invention has found through a series of experimental achievements that important factors for producing fine grains of concrete sand include the properties, shape, and size of each medium stone, the supplying ratio of the material sand relative to water, and the relations between the size of the cylindrical drum and the number of the medium stones and between the size and the rotation of the cylindrical drum. Hence, the present invention is directed towards an improved method of making concrete sand, in which the foregoing factors are provided at optimum level for achievement of the purpose.

A concrete sand making method according to the present invention comprises the steps of: feeding material sand and water into the milling chamber of a first cylindrical drum loaded with a pile of medium stones; milling the material sand with the water and the medium stones in the milling chamber by rotating the first cylindrical drum with a drive device; and unloading concrete sand produced by the milling action from the material sand together with the used water from the milling chamber, in which the medium stones are prepared using a medium stone producing apparatus which comprises a second cylindrical drum having a milling chamber, a drive device for rotation of the second cylindrical drum, an opening provided in one side wall of the second cylindrical drum for serving as both a feeding inlet and a discharge outlet, a spiral blade mounted about the opening to the inner side of the side wall of the second cylindrical drum for feeding material stones towards the center of the milling chamber during the forward rotation of the second cylindrical drum and discharging the same from the milling chamber through the opening during the reverse rotation, and a dust collector mounted to the other side wall of the second cylindrical drum.

Also, the medium stones are prepared by examining material stones of rubbles using an alkali-silica reaction test, selecting desired material stones which are determined acceptable by the test and are more than 2.65 in the absolute dryness specific weight and 5 to 150 mm in diameter, feeding the selected material stones into the inner space of a second cylindrical drum, grinding the material stones by means of rotation of the second cylindrical for a given period of time, dividing the ground material stones into a particular number of groups according to their size, and determining a desired combination of the material stones of different sizes for use through selecting from the groups.

The pile of the medium stones loaded in the first cylindrical drum is maintained to a height equal to $\frac{1}{4}$ to $\frac{1}{3}$ the inner diameter of the first cylindrical drum.

The supply of the water is controlled in precise or approximate proportion to the feeding of the material sand. The number of rotation of the first cylindrical drum is decreased as the inner diameter of the same increases.

According to the method of the present invention, medium stones are prepared with the medium stone producing apparatus, prior to making of concrete sand, in which rubble stones are fed into the inner milling chamber of the second cylindrical drum through the opening provided in the side wall of the same and agitated for grinding. During the grinding, the second cylindrical drum rotates in a right direction and the spiral blade mounted about the opening on the inner side of the side wall of the same presses the rubble stones towards the center of the milling chamber. More particularly, the grinding of the rubble stones will be encouraged by not only the parallel ribs on the inner side of the second cylindrical drum but also the spiral blade on the side wall, thus preventing any jam of the rubble stones at the opening end of the milling chamber. Also, the dust collector mounted to the other side wall of the second cylindrical drum performs a sucking action of dust generated during the grinding so that no dust can remain affecting adversely. The grinding action is carried out for a given duration of time, whereby the rubble stones are ground into round shape. Upon completion of the grinding action, the second cylindrical drum is switched over to rotate in the reverse direction by the drive device. Hence, the rubble stones (now, medium stones) are moved by the spiral blade along the inner side of the side wall towards the opening and unloaded from the second cylindrical drum through the opening. The spiral blade permits a systematic unloading movement of the medium stones and also, allows both the feeding and the discharging actions to be executed through one single opening provided in the side wall of the second cylindrical drum. The other side wall of the second cylindrical drum can thus be utilized for installation of the dust collector.

The medium stones are also selectively used through examining their acceptable properties by the common alkali-silica reaction test and their fragments resulting from worn-off during the grinding will not react with alkali components of a cement when mixed in the aggregate sand thus producing no unfavorable effect, e.g. expansion, to a finished concrete solid. The medium stones of more than 2.65 in the absolute dryness specific weight and 5 to 150 mm in the overall size are selected so that their pressing or abrasive force to the material sand can be appropriate during the grinding in water. Thus, the medium stones can contribute to production of the concrete sand of desired quality and will be prevented from fragmentation to bits. The medium stones ground for a given time are divided into groups depending on their size. Accordingly, it is necessary to determine an optimum combination of the medium stones of different sizes for providing the most favorable conditions during the grinding action thus producing a desired quality of concrete sand.

For making concrete sand, a given combination of the medium stones of different sizes are loaded into the first cylindrical drum and agitated with water for milling the material sand. The medium stones are piled to a height equal to $\frac{1}{4}$ to $\frac{1}{3}$ the inner diameter of the first cylindrical drum. More particularly, the medium stones are piled from the lowermost of the milling chamber to $\frac{1}{4}$ to $\frac{1}{3}$ the height of the same. When the pile of the medium stones becomes low in height due to worn-off, a corresponding amount of the medium stones are resupplied so that the pile height is not less than $\frac{1}{4}$ the inner diameter but also not more than $\frac{1}{3}$. The height of the pile of the medium stones thus remains within a range from $\frac{1}{4}$ to $\frac{1}{3}$ the inner diameter.

The supply of the material sand can be increased for producing a more amount of the concrete sand from the first cylindrical drum. Whenever the supply of the material sand is increased, the supply of the water is also increased in precise or approximate proportion so that the fluidity of the material sand in the first cylindrical drum remains at optimum. This allows the medium stones to perform a constant milling action to the material sand thus producing the concrete sand of uniform quality.

If the first cylindrical drum has to be changed in the size corresponding to the area of an installation space or the arrangement of facility and for example, its inner diameter is increased, its rotation can be controlled to a slower speed so that the circumferential speed at the inner side of the first cylindrical drum remains at an optimum rate and the medium stones are prevented from elevating too high or too low.

DETAILED DESCRIPTION OF THE INVENTION

One preferred embodiment of the present invention will be described.

Figure 9:
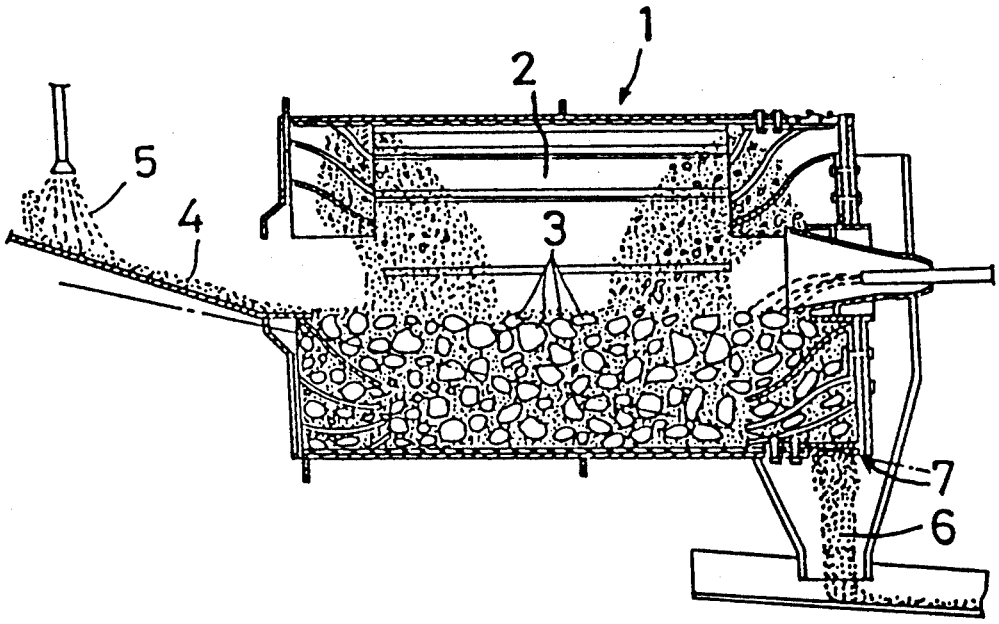
FIG. 9 is a longitudinal cross sectional view of an apparatus for making concrete sand.

An apparatus is provided for producing medium stones which are used in a concrete sand making apparatus, shown in FIG. 9, for making fine grains of sand 6.

Figure 1:
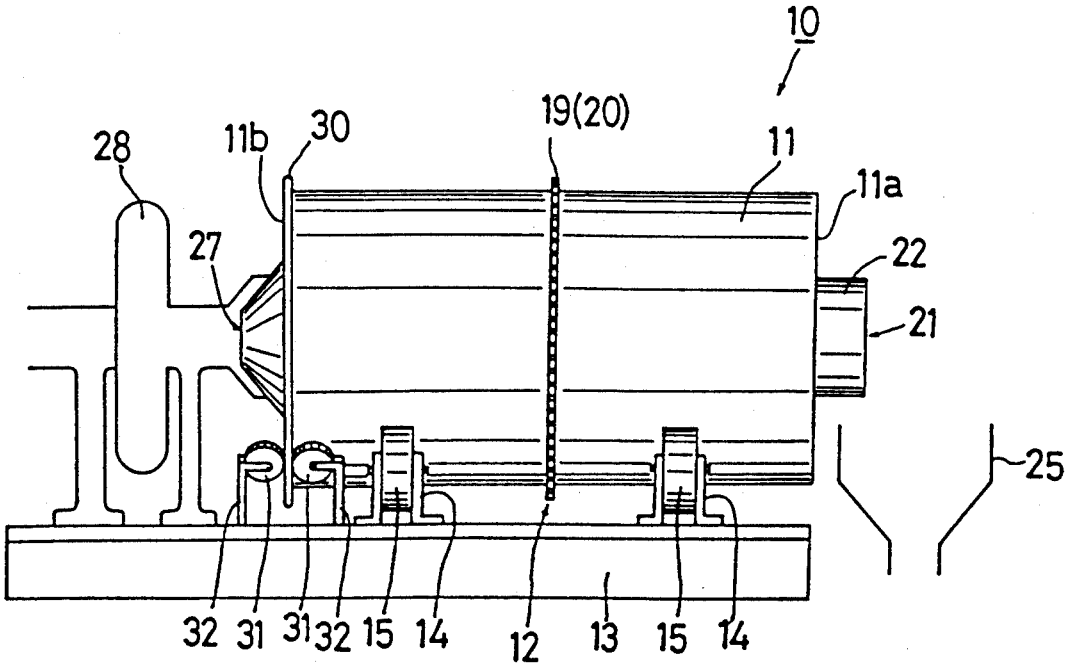
FIG. 1 is a front view of an apparatus of producing medium stones.
Figure 2:
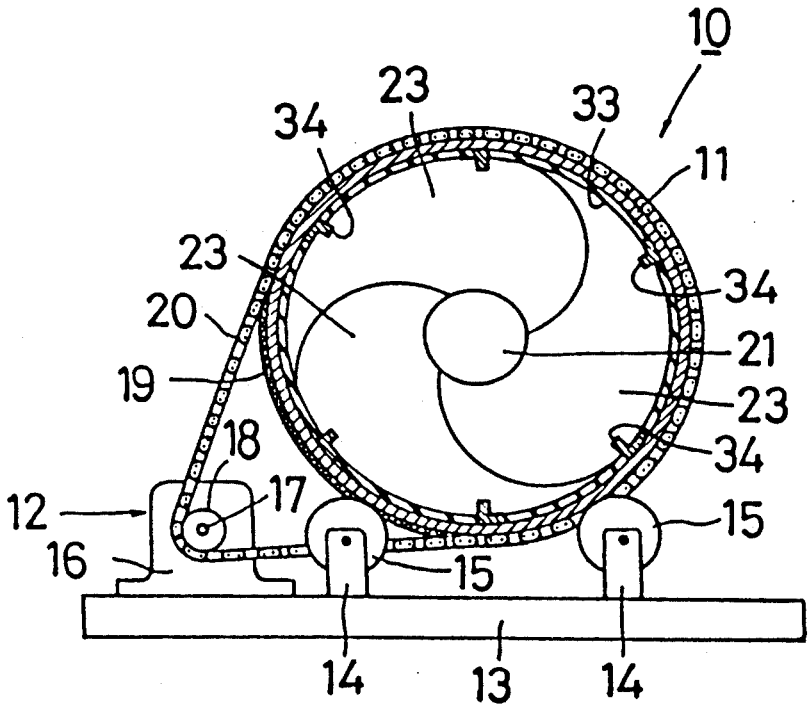
FIG. 2 is a cross sectional view of a primary part of the medium stone producing apparatus showing one end of the interior of a second cylindrical drum.

The medium stone producing apparatus 10 illustrated in FIGS. 1 and 2 has a second cylindrical drum 11 of which interior forms a milling chamber and a drive device 12 for actuating the second cylindrical drum 11.

The drive device 12 comprises a base 13, four rollers 15 mounted for rotation by brackets 14 on the upper surface of the base 13, a motor 16 mounted to one side of the upper surface of the base 13, a drive sprocket 18 fixedly mounted to a rotating shaft 17 of the motor 16, an idler sprocket 19 fixedly mounted to a center region of an axially extending outer wall of the second cylindrical drum 11, and a chain 20 mounted between the two sprockets 18 and 19. In action, the rotation of the motor 16 is transmitted through the chain 20 to the second cylindrical drum 11 which thus rotates on the four rollers 15. The two sprockets 18, 19 may be toothed wheels or V-belt pulleys. The chain 20 may be a timing belt or V-belt. The number of rollers 15 is not limited to four and may be more than four (for example, eight).

Figure 3:
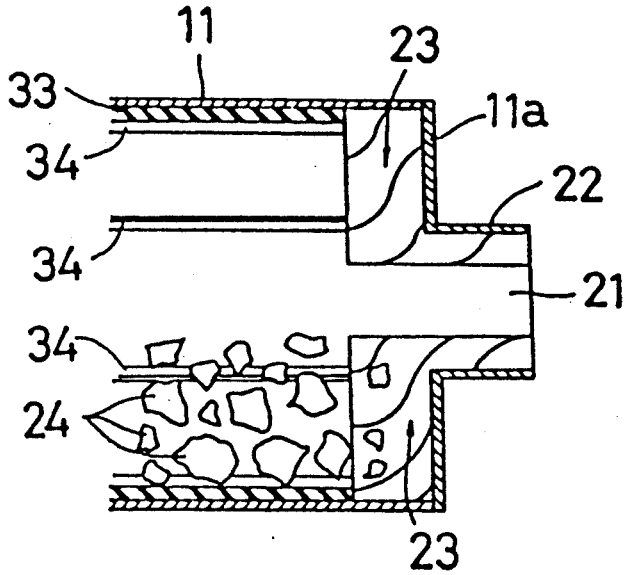
FIG. 3 is a longitudinal cross sectional view of the same end of the interior of the second cylindrical drum of the medium stone producing apparatus.

The second cylindrical drum 11 has an opening 21 provided in the center of one side wall 11*a* thereof which serves as both a feeding inlet and an outlet for rubbles or material stones, as shown in FIGS. 1 to 3. A small-diameter tube 22 is arranged about the opening 21 extending outwardly from the side wall 11*a*. Also, a spiral blade 23 is mounted about the opening 21 to the inner side of the side wall 11*a*. When the second cylindrical drum 11 rotates in a right direction with rubble stones 24 being loaded in its milling chamber, the spiral blade 23 performs an action for moving the rubble stones 24 towards the center of the chamber (or the left) as best shown in FIG. 3. When it rotates in a reverse direction, the spiral blade 23 presses the rubble stones 24 towards the opening 21 for unloading. In addition, a chute 25 is provided directly beneath the opening 21 (or the tube 22) for downward transfer of the unloaded stones, as shown in FIG. 1.

Figure 4:
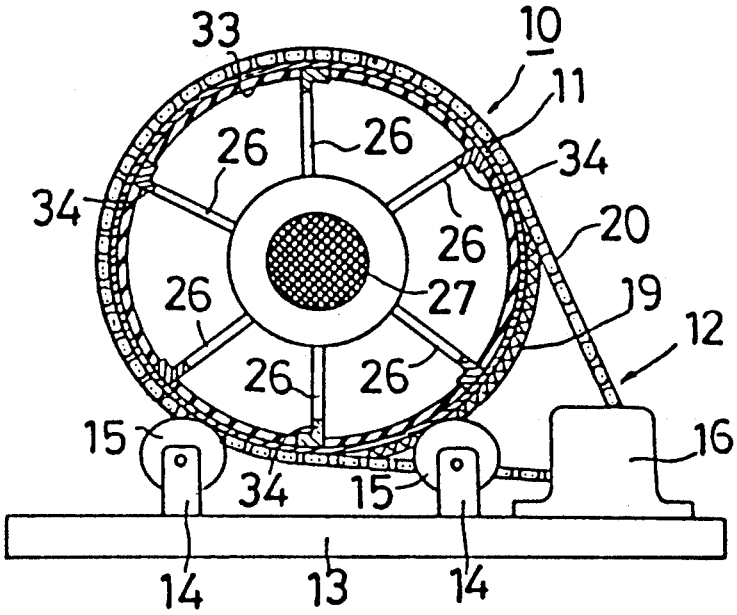
FIG. 4 is a cross sectional view of a primary part of the medium stone producing apparatus showing the other end of the interior of the second cylindrical drum.
Figure 5:
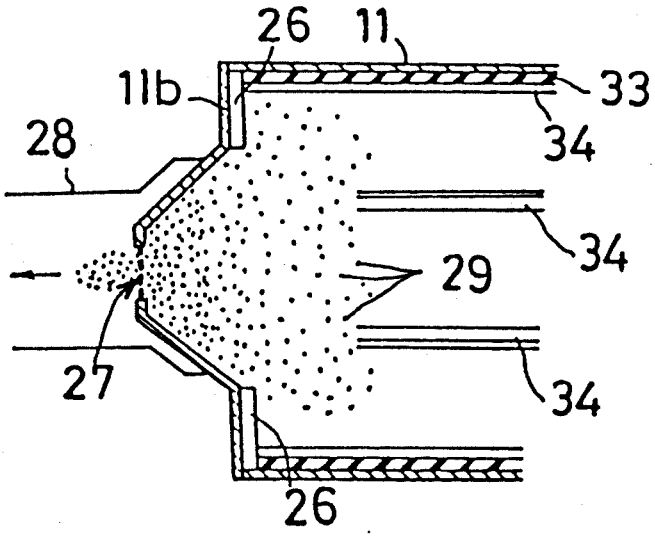
FIG. 5 is a longitudinal cross sectional view of the other end of the interior of the second cylindrical drum of the medium stone producing apparatus.
Figure 6:
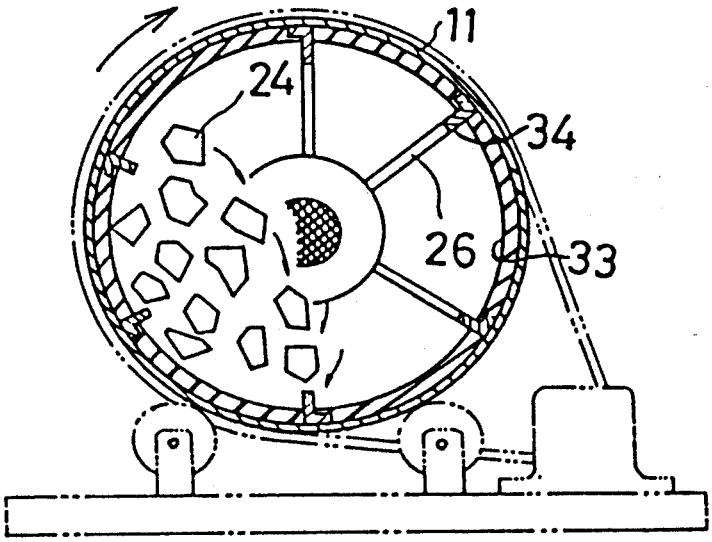
FIG. 6 is a cross sectional view showing the production of medium stones.

As shown in FIGS. 1, 4, and 5, the other side wall 11*b* of the second cylindrical drum 11 has on the inner side a plurality of radially extending mixing ribs 26 and at center a dust outlet 27 provided with a net filter. The dust outlet 27 is communicated at outer end with a dust collector 28. In action, dust 29 generated during the milling action is blown out from the dust outlet 27 of the side wall 11*b* to the dust collector 28, as shown in FIG. 5. A flange 30 is provided about the outer edge of the side wall 11*b* of the second cylindrical drum 11, as shown in FIG. 1, and at lower side end sandwiched for movement by a pair of sub-rollers 31, which are in turn mounted by two sub-brackets respectively on the base 13. A single sub-roller having a circumferentially extending groove at center for supporting the flange 30 may be used in place of the two sub-rollers 31. Also, any other applicable arrangement for supporting the flange 30 will be possible.

The inner surface of the second cylindrical drum 11 is entirely protected with a rubber sheet 33 which acts as an impact relief cushion and also, provided with a plurality of equally spaced parallel mixing ribs 34 extending lengthwisely of the drum 11, as shown in FIGS. 2 to 5.

The medium stone producing apparatus 10 is adapted for rounding the rubble stones 24 which are directly supplied from a quarrying plant. It should be noted that the rubble stones 24 are of the type which clears an alkali-silica reaction test. Such an alkali-silica reaction test will be conducted according to "the (chemical) method of testing alkali-silica reaction of aggregate" stipulated in Appendix 7 of JIS A5308 (1989) or "the mortar bar method" depicted in Appendix 8 of the same. In addition, the rubble stones 24 are more than 2.65 in the absolute dryness specific weight and 5 to 150 mm in the size.

Figure 11:
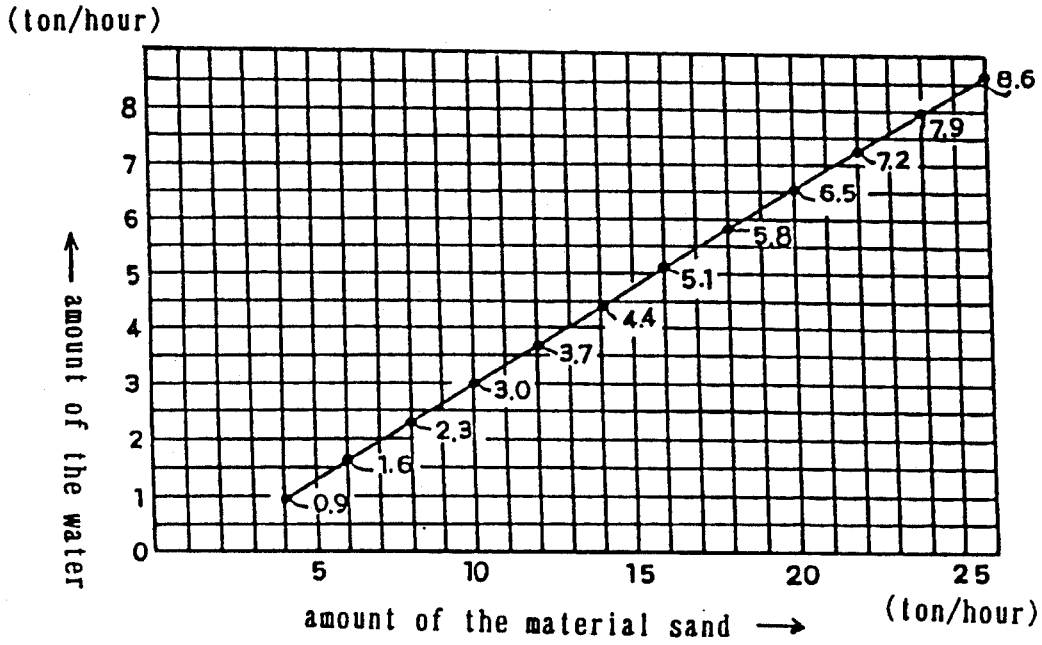
FIG. 11 is a graphic diagram showing the relation between the supply of water and the feeding of material sand.

In operation, the rubble stones 24 are loaded through the opening 21 (or the tube 22) of the side wall 11*a* of the second cylindrical drum 11 into the inner milling chamber and then, the drive device 12 is actuated to rotate the second cylindrical drum 11. As shown in FIG. 11, the rotation of the second cylindrical drum 11 causes a rolling action of the rubble stones 24 and the resultant powders of dust 29 are blown out to the dust collector 28. The grinding action is accelerated for more efficient and positive movement by the spiral blade 23 on the side wall 11*a*, the radially extending mixing ribs 26 on the other side wall 11*b*, and the parallel mixing ribs 34. Simultaneously, the rubber sheet 33 bonded to the inner surface of the second cylindrical drum 11 relieves impact stresses exerted onto the rubble stones 24. Those movements simulate the natural actions of river water by which angular rubbles are ground to pebbles and gravel stones in a short period of time. After the grinding action through a given time, the drive device 12 is switched over to rotate the second cylindrical drum 11 in the reverse direction. As the second cylindrical drum 11 rotates in the reverse direction, the rubble stones 24 move along the spiral blade 23 of the side wall 11*a* towards the opening 21 (or the tube 22) prior to being discharge out of the opening 21 to the chute 25 for downward transfer.

Figure 7:
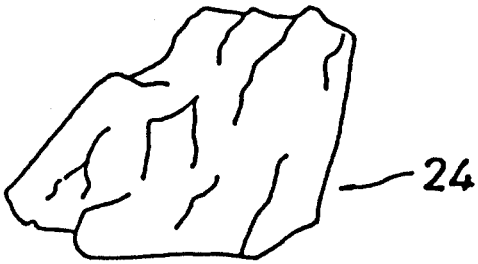
FIG. 7 is a schematic front view of a rubble stone prior to grinding to a medium stone.
Figure 8:
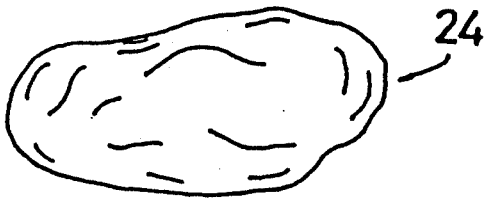
FIG. 8 is a schematic front view of a medium stone after grinding.

During the grinding action, the rubble stones 24 which have angular surfaces as illustrated in FIG. 7 are rounded to a shape shown in FIG. 8 or turned to medium stones 3.

Then, the finished medium stones 3 are divided by a screen classifier into groups depending on their size. More specifically, a first group contains stones ranging from 80 mm to 100 mm in diameter, a second group from 60 mm to 80 mm, a third group from 40 mm to 60 mm, a fourth group from 20 mm to 40 mm, and a fifth group from 13 mm to 20 mm. A desired number of the medium stones to be used for milling are selected from the groups in order to have a proper combination of the medium stones of different sizes for producing appropriately sized grains of concrete sand. The preferred combination of the medium stones consists of 5% the first group stones, 12.5% the second group, 20% the third group, 27.5% the fourth group, and 35% the fifth group. Since five different size groups of the medium stones are prepared, concrete sand of any grain size can be produced with the use of an optimum combination of the medium stones of different sizes.

Figure 10:
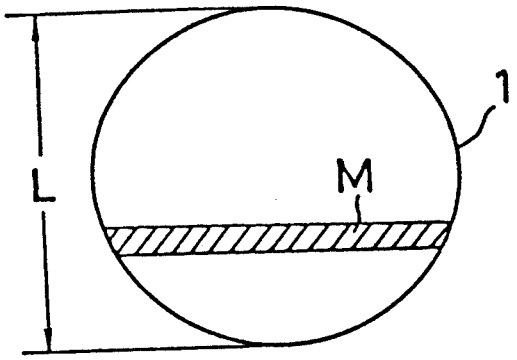
FIG. 10 is a schematic view showing the relation between the size of a first cylindrical drum and the amount of medium stones.

The medium stones 3 prepared by the foregoing manner are placed in a pile in the first cylindrical drum 1 of the concrete sand making apparatus shown in FIG. 9 prior to being mixed with the material sand 4 and the water 5. The pile of the medium stones 3 comes up to a height equivalent to $\frac{1}{4}$ to $\frac{1}{3}$ the inner diameter L of the first cylindrical drum 1. More particularly. the top of the pile should be in the hatching area denoted by M in FIG. 10. When the medium stones 3 are worn to the lower limit ($\frac{1}{4}$ of L) of the range M during the milling action produced by the rotation of the first cylindrical drum 1, a new supply of the medium stones is needed, on the condition that the top of the pile is not higher than the upper limit ($\frac{1}{3}$ of L) of the range M and remains between $\frac{1}{3}$ and $\frac{1}{4}$ of L. An excessive supply of the medium stones may result in a declination in the milling action because the movement of the medium stones in the drum is limited and disturbed by their own mass. On the other hand, a shortage of the medium stones may cause their pressing force to be unevenly exerted onto the material sand or result in the reduced load thus diminishing the grinding effect. The material sand 4 is preferably less than 5 mm in the grain diameter of sea sand, mountain sand, dust produced in quarries, or the like.

The optimum supply of material sand and water was examined through a series of experimental actions in which different amounts of material sand and water were loaded into the rotating first cylindrical drum and the flow of the material sand throughout the milling chamber was monitored. As apparent from the result shown in FIG. 11, it was found that the amount of the material sand was approximately proportional to the amount of the water for optimum supply. The proportional relation between the sand and the water shown in FIG. 11 remains unchanged when the first cylindrical drum 1 is varied in the size or rotating speed.

The duration of the water traveling across the first cylindrical drum 1 or more specifically, from supply of the water to discharge from the outlet was measured while the first cylindrical drum 1 is filled to about $\frac{1}{3}$ the interior with the medium stones and rotated at a speed of 26 rpm. In particular, the first cylindrical drum 1 which is 120 cm in the outer diameter (116.5 cm in the inner diameter) and 200 cm in the length was loaded with a pile, 35 cm high, of the medium stones weighing 930 kg. The resultant measurements are shown in a graphic diagram of FIG. 12.

Figure 13:
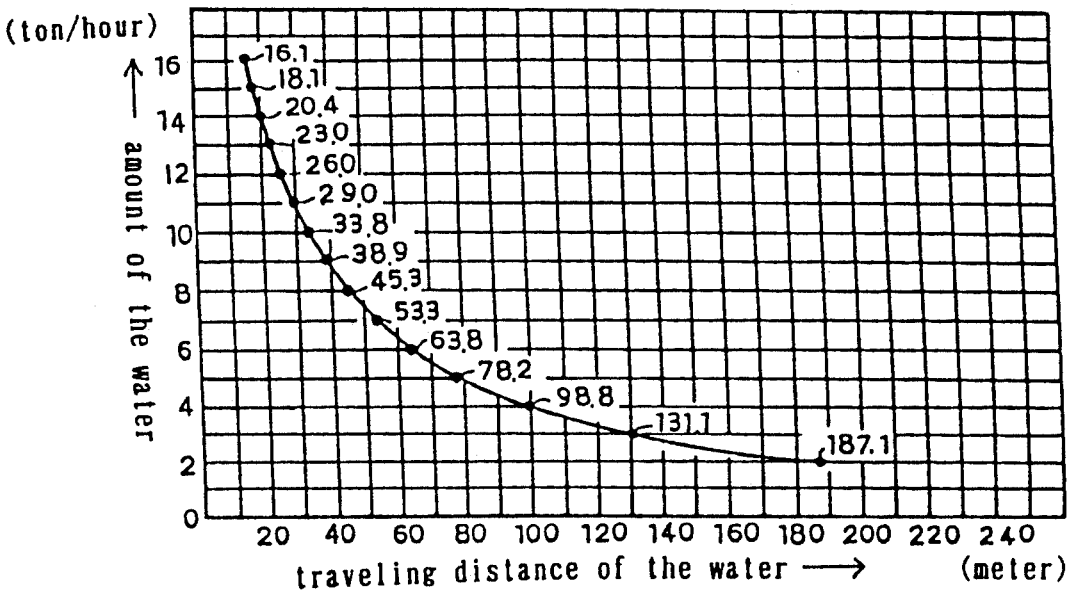
FIG. 13 is a graphic diagram showing the relation between the supply amount and the traveling distance of water.

The traveling distance of the water is calculated by multiplying the resultant traveling time by both the circumference and the rotating speed of the first cylindrical drum, as shown in FIG. 13. An optimum of the water traveling distance is then determined from reading of the measurements shown in FIG. 13 so that the concrete sand satisfying the requirements of JIS A5004 and A5308 can be produced through mixing the material sand with the medium stones and the water in the first cylindrical drum. It is now understood that the traveling distance of 100 to 150 m is most desired.

Figure 12:
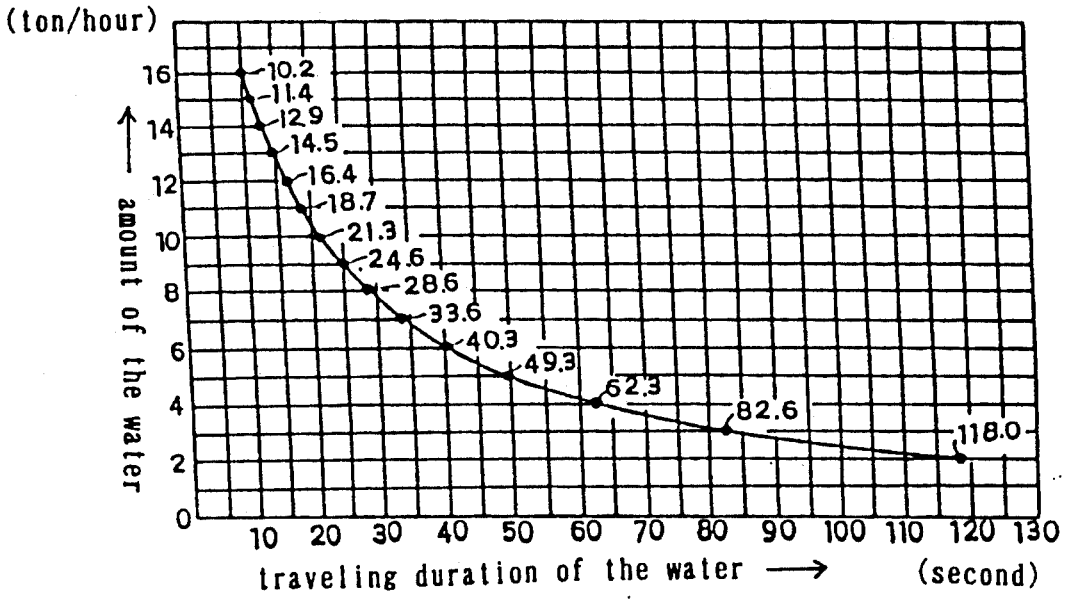
FIG. 12 is a graphic diagram showing the relation between the supply amount and the traveling time of water.

As apparent from the graphic diagram of FIG. 13, the distance of water traveling is about 60 m when the material sand is fed at 20 t/h with the water being supplied at 6.5 t/h as learned from FIG. 11, and transferred in about 37 seconds as learned from FIG. 12. Hence, when the material sand supplied at 20 t/h and discharged from the outlet of the first cylindrical drum is carried again throughout the first cylindrical drum together with the water supplied at 6.5 t/h, the total traveling distance of the water becomes 120 m which falls in the most desired traveling range from 100 m to 150 m. The concrete sand of desired quality can thus be produced through mixing with the medium stones and the water when the water traveling distance is 100 to 150 m.

While the rotation of the first cylindrical drum of 120 cm in diameter is 26 rpm according to the embodiment, the same of a cylindrical drum which is e.g. 60 cm in the diameter should be as low as 27 rpm for optimum effect. If the rotation of the first cylindrical drum is fast, the circumferential speed is increased thus lifting the medium stones too high. This will cause increasing the impact and declining the milling action. If the rotation is too low, the circumferential speed of the first cylindrical drum will be decreased thus retarding the movement of the material sand. It is hence needed that the first cylindrical drum is controlled in the rotation corresponding to its diameter in order to maintain its inner circumferential speed constant. When the diameter is 60 cm, the rotation should be 27 rpm. Similarly, the water traveling time is measured while the 60-cm diameter cylindrical drum loaded with the medium stones being rotated at 27 rpm and the resultant measurements are expressed in a graph showing the relation between the traveling time and the supply of water. Then, the water traveling distance relative to the supply is calculated by multiplying the water traveling time by both the circumference and the rotation of the drum. Also, the resultant distance is expressed in a graph showing the relation to the supply of the water. Finally, the supply of material sand is determined from reading of the foregoing graph and the graph of FIG. 11 on the condition that the water traveling distance is in a range from 100 m to 150 m. Accordingly, the concrete sand produced in this manner will satisfy the requirements of JIS A5004 and A5308.

As set forth above, the method of making concrete sand according to the present invention ensures the optimum use of medium stones which are most favorable in the size, shape, and property and also, allows the relations between the size of a cylindrical drum and the supply of material sand and between the size and the rotation of the cylindrical drum, and between the supply of the material sand and the supply of water to be determined for optimum effects. Accordingly, the milling or grinding action to the material sand will be enhanced thus producing concrete sand of desired quality.

I claim:

1. A method of making a concrete sand comprising the steps of:

subjecting a quantity of material stones to an alkali-silica reaction test to select desired material stones;

feeding said desired material stones in a second cylindrical drum;

rotating said second cylindrical drum in a forward direction to grind said desired material stones forming medium stones while preventing discharge of said desired material stones by means of a spiral blade which rotates in a forward direction;

rotating said second cylindrical drum in a backward direction to unload said medium stones by means of said spiral blade which now rotates in a backward direction;

loading a quantity of said medium stones in a first cylindrical drum;

feeding a quantity of material sand and a quantity of water into said first cylindrical drum;

rotating said first cylindrical drum to grind said material sand with said medium stones to form concrete sand; and unloading said concrete sand together with used water.

2. A method of making concrete sand comprising the step of:

subjecting a quantity of material stones to an alkali-silica reaction test to select desired material stones;

feeding said desired material stones into a second cylindrical drum;

rotating said second cylindrical drum in a forward direction to grind said desired material stones forming medium stones while preventing discharge of said desired material stones by means of a spiral blade which rotates in a forward direction;

rotating said second cylindrical drum in a backward direction to unload said medium stones by means of said spiral blades which now rotates in a backward direction;

classifying said medium stones into a plurality of groups in terms of size;

loading a first cylindrical drum with a combination of different groups of said medium stones according to a desired grain size of concrete sand;

feeding a quantity of material sand and a quantity of water into said first cylindrical drum; and rotating said first cylindrical drum to grind said material sand with said medium stones to produce concrete sand of said desired grain size.

3. The method of making concrete sand of claim 2, wherein a traveling distance of said water is in a range between 100 and 150 meters.

4. The method of making concrete sand of claim 2, wherein said material stones have an absolute dryness specific weight of more than 2.65.

5. The method of making concrete sand of claim 2, wherein said classification of medium stones consists of a first group containing 13–20 mm dia. stones, a second group containing 20–40 mm dia. stones, a third group containing 40–60 mm dia. stones, a fourth group containing 60–80 mm dia. stones, and a fifth group containing 80–100 mm dia. stones.

6. The method of making concrete sand of claim 5, wherein said combination of different groups of said medium stones consists of 5% said first group of stones, 12.5% said second group of stones, 20% said third group of stones, 27.5% said fourth group of stones, and 35% said fifth group of stones.

* * * * *